US006273041B1

(12) United States Patent
Haas et al.

(10) Patent No.: US 6,273,041 B1
(45) Date of Patent: Aug. 14, 2001

(54) CAM FOLLOWER IN A VALVE TRAIN OF AN INTERNAL COMBUSTION ENGINE SWITCHABLE BETWEEN DIFFERENT LIFTS FOR AT LEAST ONE GAS-EXCHANGE VALVE

(75) Inventors: Michael Haas, Weisendorf; Henning Karbstein, Strullendorf; Norbert Nitz, Niex, all of (DE)

(73) Assignee: INA Walzlager Schaeffler oHG (DE)

( * ) Notice: Subject to any disclaimer, the term of this patent is extended or adjusted under 35 U.S.C. 154(b) by 0 days.

(21) Appl. No.: 09/600,508

(22) PCT Filed: Oct. 9, 1998

(86) PCT No.: PCT/EP98/06400

§ 371 Date: Sep. 5, 2000

§ 102(e) Date: Sep. 5, 2000

(87) PCT Pub. No.: WO99/36678

PCT Pub. Date: Jul. 22, 1999

(30) Foreign Application Priority Data

Jan. 17, 1998 (DE) ..... 198 01 603

(51) Int. Cl.[7] ..... F01L 13/00; F01L 1/14

(52) U.S. Cl. ..... 123/90.16; 123/90.5; 123/198 F

(58) Field of Search ..... 123/90.16, 90.17, 123/90.48, 90.49, 90.5, 90.55, 198 F

(56) References Cited

U.S. PATENT DOCUMENTS 5,782,216 * 7/1998 Haas et al. ..... 123/90.16

5,878,705 * 3/1999 Maas ..... 123/90.16

FOREIGN PATENT DOCUMENTS

| | | |
|---|---|---|
| 4327905 | 2/1995 | (DE) . |
| 19544527 | 6/1996 | (DE) . |
| 19622174 | 6/1997 | (DE) . |
| 19642718 | 4/1998 | (DE) . |

* cited by examiner

*Primary Examiner*—Weilun Lo
(74) *Attorney, Agent, or Firm*—Volpe & Koenig, PC

(57) ABSTRACT

A cam follower (1) designed to be switchable between different lifts for at least one gas-exchange valve and includes two adjacent sections (2,4) which can be coupled together via a coupling element (15). The coupling element (15) cooperates with a shutoff slide (14). It is a special feature of the shut-off slide (14) that it is produced as a mechanically closable and openable piston for an inlet (22) in a pressure chamber (20) in front of the coupling means (15), the piston, however, being maintainable hydraulically in its open position via high switching pressure. At the same time, the shutoff slide (14) is completely incorporated in the cam follower (1) and does not extend beyond it. As a result, undesired fluctuations in the pressure of the hydraulic fluid can no longer act on the coupling means (15) during the base circle of the cams acting on the cam follower (1) and an intended turned-off state. At the same time, displacement of these coupling means (15) in their coupling direction is only possible if a sufficiently high pressure of the hydraulic fluid is available for such movement. Otherwise, the shutoff means (14), via the force of a pressing means (10), will close the inlet (22) for hydraulic fluid.

8 Claims, 1 Drawing Sheet

CAM FOLLOWER IN A VALVE TRAIN OF AN INTERNAL COMBUSTION ENGINE SWITCHABLE BETWEEN DIFFERENT LIFTS FOR AT LEAST ONE GAS-EXCHANGE VALVE

BACKGROUND OF THE INVENTION

The present invention concerns a cam follower in a valve train of an internal combustion engine switchable between different lifts for at least one gas-exchange valve and having the following characteristics:

a) the cam follower includes at least two adjoining sections acted upon by cams with different lift, one of these sections alternatively not cooperating with a cam;

b) the sections possess cavities preferably aligned with each other in a cam base-circle phase, movable coupling means in at least one of the cavities, the means being positioned in the decoupled state of the sections completely in their cavity;

c) the coupling means can be shifted in the coupling direction via hydraulic fluid which can be delivered via an inlet to a pressure chamber formed by their cavity axially in front of their end wall on the pressure-chamber side, the means being shiftable across a separating surface between the sections for coupling of the sections such that part of the means engages in the adjoining cavity;

d) the coupling means communicate with locking or shut-off means.

A cam follower of this type with locking means is known from DE-OS 196 22 174. According to FIG. 8, for example, its locking means have the form of a ball which is designed to engage in positive fashion into the piston-shaped coupling means. Here, the ball extends beyond a cavity for the coupling means in the direction of the cam shaft. An engaging cam, in turn, possesses on its outer wall a partially recessed annular groove which cooperates with the ball for locking purposes.

A disadvantage of this type of cam follower is the fact that the locking means require complicated changes to already existing cams of cam shafts. At the same time, unnecessarily high wear occurs in this region of the locking means through the cam contact. If hydraulic fluid is introduced ahead of the coupling means possessing the locking means, one also has to reckon with an additional loss of hydraulic fluid via the recess in the cam follower for the locking means. One likewise finds that the measures undertaken on the mentioned cam follower for locking its coupling means outside the desired cam-contact phases themselves necessitate complicated changes in the cam follower. At the same time, the stiffness of the locking means can lead in rare cases to undesired loading or destruction of structural parts.

SUMMARY OF THE INVENTION

The object of the present invention is therefore to provide a cam follower of the type described above in which the mentioned disadvantages are eliminated.

The locking means are produced according to the present invention as a mechanically closable and openable shut-off slide for the inlet to the pressure chamber (the slide, however, being maintainable hydraulically in its open position via high switching pressure) and/or the shut-off means are completely incorporated in the cam follower and do not extend beyond it.

This inventive shutting off and opening is realized in the embodiment of the present invention via a signal track on the outer shell of one of the sections. As a result, the difficult-to-produce signal tracks on the opposing cam can be foregone. The wear otherwise found in this area is eliminated. However, also conceivable here is positioning the signal track in the area of a structure surrounding the cam follower (e.g., the cylinder head).

As a result of the fact that the shut-off means are maintained hydraulically in their open position only with high switching pressure, they close the inlet for hydraulic fluid to the pressure chamber ahead of the coupling means when there is insufficient hydraulic fluid pressure. Thus, using the signal track in the disengaged state of the sections and advantageously at their maximum relative lift, the inlet is checked for sufficiently high hydraulic fluid pressure. If this is sufficient, then the slide, after being opened by the signal track, is held or shifted by the applied hydraulic fluid pressure such that it frees a sufficient cross-section at the inlet for displacement of the coupling means. In the following base circle phase, the consequently hydraulically pre-tensioned coupling means are shifted with extremely high certainty and speed into their opposing cavity for coupling of the sections (see also figure description).

In appropriately developing the present invention further, it is proposed that the cam follower be designed as a cup-shaped tappet. The range of protection of the present invention relates, however, to any other type of cam follower, especially lever-like cam followers such as rocker-arm or finger-lever pairs. Also conceivable are cam followers in which three or more levers are positioned next to each other and can be joined by coupling means for purposes of different lift. Naturally, the means for coupling these levers can then likewise be provided with the inventive shut-off means.

The end wall of the coupling means facing the pressure chamber communicates according to the present invention only sectionally with the end wall of the shut-off means facing the pressure chamber so that the hydraulic fluid can be delivered with sufficient speed to the pressure chamber formed between these end walls upon shifting of this packet by the signal track.

As elastic means for loading the shut-off means, a compression spring is proposed, for example. However, any other spring means are conceivable here, including magnetic or even hydraulic loading of the shut-off means in the direction of the pressure chamber.

In an appropriate embodiment of the present invention, the tappet exhibits a hydraulic lash-adjusting element in the area of its circular section. This is advantageously loaded by hydraulic fluid pressure via a separate hydraulic fluid path.

In order to minimize surface pressure in the case of coupling of the sections by the coupling means and in order to provide means for expelling the coupling means in the decoupling direction, it is proposed according to the present invention to apply in the circular section a slide extending over the entire length of this section's cavity. In case of coupling of the sections, this slide engages in a cavity in the annular section lying diametrally opposite the cavity for the coupling means. As a result of this "symmetric" coupling, even a minimal skewing of the sections with respect to each other during coupling is simultaneously avoided. The annular section is advantageously loaded in the area of its base by two cams with an equal and large lift. These cams enclose a cam with small lift for the circular section. If the acted-on gas-exchange valve is to remain completely closed in the decoupled state of the sections, one can forego the small-lift cam or have the small cam produce only a minimal lift.

In carrying out the present invention, it is proposed that the slide be provided with a compression spring. This spring, for example, can surround the slide. The compression spring loads the slide in the decoupling direction and causes displacement of the coupling means completely into their cavity for the case of desired decoupling upon decreasing hydraulic fluid pressure. Here, the force of this compression spring is designed to be stronger than the force of the compression spring loading the shut-off means. At the same time, this compression spring acting on the slide also plays a role in keeping coupling from being realized upon insufficiently high switching pressure of the hydraulic fluid. However, it is also conceivable to load the slide in the decoupling direction via hydraulic fluid. A further suitable form of loading would involve having an additional structural member, for example, another slide, operating in the cavity diametrally opposing the cavity for the shut-off means. This could act on the slide in the decoupling direction via the mentioned loading means (hydraulic, mechanical) and optionally also form or include a stop.

The cited spring means for the shut-off means are designed such that they permit displacement of the shut-off means in their opening direction via hydraulic fluid pressure when this pressure is lower than the high switching pressure, but higher than low hydraulic pressure.

It is advantageous if the cavity for the coupling means and the diametrally opposing cavity in the annular section each possess radially outwardly a stop for the coupling means or the slide. The maximum displacement travel of the mentioned elements is defined by this stop. The stops can be provided with openings, e.g., boreholes. Air displaced during the shifting movement of the coupling means with shutoff means and slide can escape via these boreholes. No undesired air cushion is formed. Likewise, leakage of hydraulic fluid can be removed from the cam follower.

It is also conceivable, for example, to combine the signal track as one piece with the circular section. However, a separate element with wedge surface, such as, for example, a rivet-like body or the like, can be joined to the outer shell of the corresponding section. As mentioned, the signal track advantageously possesses its maximum elevation in the area of maximum relative position of the sections with respect to each other. Thus, with receding cam flank, the coupling means can be provided with hydraulic fluid pressure for the case of their desired coupling. If this pressure does not suffice (high switching pressure), the shut-off means close the inlet via the force of their pressing means. Coupling can then first occur in one of the following base-circle cycles.

BRIEF DESCRIPTION OF THE DRAWINGS

The present invention is explained in more detail on the basis of the drawings. In the drawings.

DETAILED DESCRIPTION OF THE PREFERRED EMBODIMENT

Figure 1:
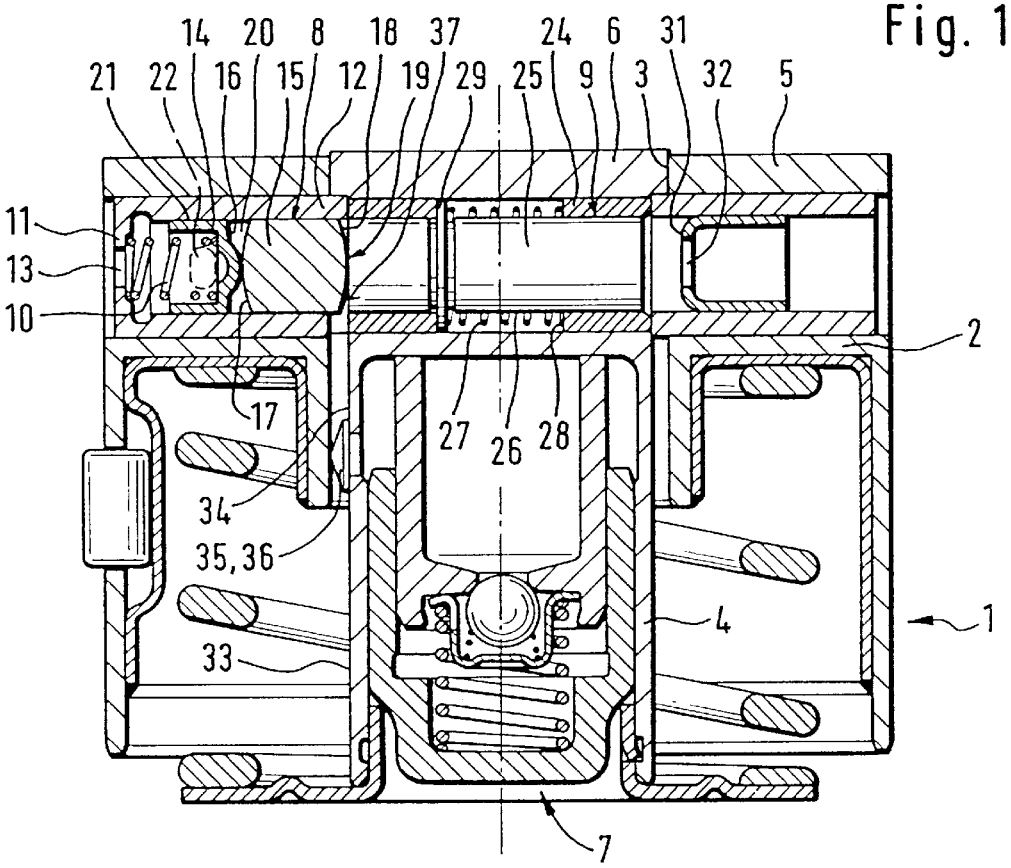
FIG. 1 is a cross-section through a cup-shaped tappet cam follower in the area of its coupling means and FIG. 2 is a cross-section through the cam follower turned by 90° compared to FIG. 1.

The Construction:

FIG. 1 shows a cam follower 1 constructed as a cup-shaped tappet. This follower includes an outer annular section 2, which encloses in the area of its borehole 3 a circular section 4 movable relative thereto. Sections 2,4 are acted on by cams of different lift in the area of their bases 5,6. Here, base 5 is contacted by at least one cam of large lift and base 6 by a cam of small lift. At the same time, section 4 is provided on its side away from the base with a hydraulic lash-adjusting element 7. This acts on one or more unshown gas-exchange valves.

During a cam base-circle phase, cavities 8,9 are aligned in the area of bases 5,6. Pressing means 10 shown as a compression spring are positioned radially outwardly in the cavity 8 shown here left of the line of symmetry. Pressing means 10 are supported radially outwardly on stop 11. The stop 11 is formed here as the base of a casing 12. This casing 12 serves with its borehole in forming cavity 8 and thus as the immediate running track. At the same time, stop 11 includes an opening 13.

The pressing means 10 act radially inwardly on a shut-off means/slide 14. The latter has a piston-like design. A piston-shaped coupling means 15 is arranged radially inwardly of shut-off means 14. In the view shown, part of a radially inner end wall 16 of shut-off means 14 lies against a radially outer end wall 17 of coupling means 15.

In the decoupled state of sections 2,4, the radially inner end wall 18 of coupling means 15 is positioned right at the separating surface 19 between these two sections.

As a result of the fact that end walls 16 and 17 lie only partly against each other, a pressure chamber 20 is formed between shut-off means 14 and coupling means 15 in the low-pressure state of the hydraulic fluid shown here and explained later.

Figure 2:
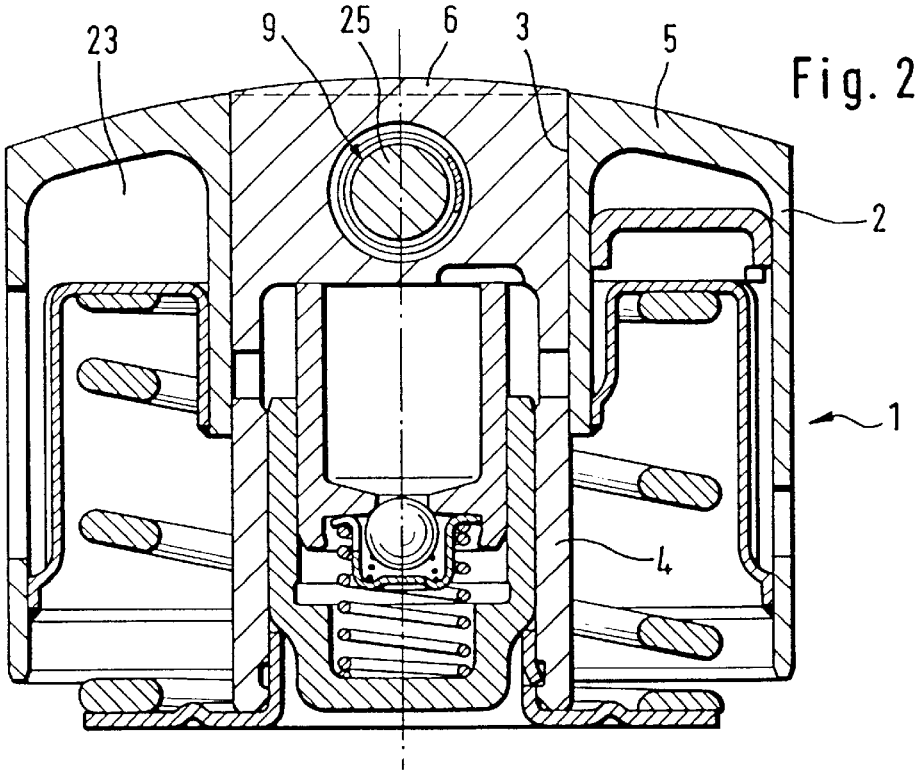

Also to be recognized here is that shut-off means 14 with the shell 21 closes off an inlet 22. This inlet 22 serves in delivering hydraulic fluid to pressure chamber 20. It is fed here from a supply chamber 23 visible in FIG. 2.

Two spaced casings 24 are included at the radially outward positions in cavity 9 of circular section 4. Thus, cavity 9 is defined by the boreholes of these casings 24. Running in cavity 9 is a slide 25 extending over the entire length of cavity 9. Approximately in the area of its cross-directional median plane, slide 25 is surrounded at its outer jacket 26 by a compression spring 27. This extends between the casings 24. Here, compression spring 27 is supported on its side away from coupling means 15 on a shoulder 28 (end wall) of casing 24. On the pressure-chamber side, the compression spring 27 is supported on a collar 29 located on the outer jacket 26 of the slide 25. The compression spring 27 holds the slide 25 in its center position. A retaining ring or the like would also be conceivable in place of the collar.

The part of cavity 8 lying diametrally opposite the part of cavity 8 for coupling means 15 possesses a casing-shaped stop 31. This likewise exhibits an opening 32. It can also be conceivable to position a third slide within the just described cavity 8. This could then be loaded radially from the outside by pressing means. Upon displacement travel of coupling means 15/shut-off slide 14 and slide 25, compressed air can escape unhindered through openings 13 and 32.

At the same time, it is clear from FIG. 1 that a signal track 34 is formed on the outer jacket 33 of section 4 surrounded by borehole 3. This signal track 34 is designed as a diametral expansion 35 extending in the direction away from the cams. It consists here of a separate body 36, e.g., of rivet-like design. It is located axially removed from the middle of the end wall 18 of coupling means 15 about in proportion to the maximum differential lift between the lift of the large cam for the annular section 2 and the lift of the small cam for the circular section 4.

Mode of Operation:

The figures show cam follower 1 in its base-circle phase and in the decoupled state. Thus, the associated gas-exchange valve would be opened only upon the cam acting on circular section 4. Annular section 2 executes relative movement with respect to circular section 4 in the sense of the cam acting on it or the large-lift cam. During this relative movement, the end wall 18 of coupling means 15 facing away from the pressure chamber slides along outer jacket 33 and over signal track 34. Approximately at maximum relative lift, this track shifts coupling means 15 with shut-off means 14 radially outwardly against the force of pressing means 10. In the process, the shell 21 of shut-off means 14 temporarily opens inlet 22. If the decoupled state is to be retained, for example, at low speed of rotation and load of the internal combustion engine, low-pressure hydraulic fluid remains directed to inlet 22. During the subsequent upward movement of annular section 2, pressing means 10 shift shut-off slide 14 radially inwardly. Coupling means 15 stand at the separating surface 19. Consequently, inlet 22 becomes closed again. Now if undesired hydraulic-fluid pressure peaks occur at the inlet 22 in the cam base circle, these peaks do not affect the closing action of shut-off means 14. Coupling means 15 can not move in undesired fashion in the coupling direction during the cam base-circle phase and thus remain in their cavity 8.

If coupling of sections 2,4 is desired, for example, with medium to high speed of rotation/load, high-pressure hydraulic fluid can be applied already very early at inlet 22. If, now, the packet consisting of coupling means 15 and shut-off means 14 is shifted radially outwardly by the signal track 34 at relative lift, the cross-section of inlet 22 is again opened mechanically. If the pressure (high pressure) applied by the hydraulic fluid exceeds the force supplied by pressing means 10, pressure chamber 20 remains open during the subsequent receding phase of the cam as a result of the existing hydraulic-fluid pressure. Coupling means 15 thus stand under sufficient inlet pressure and can immediately be shifted into the aligned cavity 9 once the base-circle position is attained. The coupling of sections 2,4 is reliably completed.

If, however, the existing high pressure of the hydraulic fluid at inlet 22 does not suffice, the mechanical opening of inlet 22 via signal track 34 will be eliminated upon receding cam phase and shut-off means 14 will shut off inlet 22 via the force of their pressing means 10 against the insufficient hydraulic-fluid pressure. Thus, coupling means 15 would be hindered in the subsequent base-circle phase from undergoing displacement in the direction of cavity 9 for purposes of coupling. Undesired wear as a result of insufficient coupling-means movement in spite of a switching command are thus avoided along with noise. Only with a sufficiently high pressure of the hydraulic fluid at inlet 22 can there be a displacement of coupling means 15 in the coupling direction during subsequent cam lift with shut-off means 14 remaining open.

What is claimed is:

1. Cam follower (1) in a valve train of an internal combustion engine switchable between different lifts for at least one gas-exchange valve and having the following characteristics:

the cam follower (1) includes a first section (2) which can be acted upon by at least one cam with a large lift and a second section (4) which is contacted by a cam with a small lift or by no cam, the second section (4) having a side away from the cam for contact with a gas-exchange valve and being capable of relative axial movement with respect to the first section (2);

the first and second sections (2,4) possess cavities (8,9) aligned with each other in a cam base-circle phase, movable coupling means (15) in at least one of the cavities (8,9), the coupling means being positioned completely in the one cavity (8,9) in the decoupled state of the first section from the second section (2,4);

the coupling means (15) being shiftable in a coupling direction by hydraulic fluid which can be delivered via an inlet (22) to a pressure chamber (20) formed by the one cavity (8,9) in front of an end wall (17) of the coupling means facing the pressure chamber (20), the coupling means being shiftable for coupling of the first with the second section (2,4) across a separating surface (19) between the sections (2,4) such that part of the coupling means engages in the other adjoining cavity (9,8); and shut-off means (14) face the coupling means (15);

characterized by the following features:

the shut-off means (14) comprising a mechanically closable and openable shut-off slide for the inlet (22) to the pressure chamber (20), the slide, being maintainable hydraulically in an open position via high switching pressure.

2. Cam follower according to claim 1, characterized by the following features:

the coupling means (15) and the shut-off means (14) are located in the cavity (8) of the first section (2) in the decoupled state of the first section (2) from the second section (4), the shut-off means (14) having a piston-like geometry and, viewed in the coupling direction of coupling means (15), lying with an end wall (16) of the shut-off means behind the end wall (17) of coupling means (15) and the pressure chamber (20) is located between the end wall (16) and the facing end wall (17);

the shut-off means (14) are loaded in a closing direction by pressing means (10) such as a spring, closing inlet (22) with a shell (21) of the shut-off means upon low pressure of the hydraulic fluid and at least during a cam base-circle phase and with a portion of the end wall (16) facing the end wall (17) of coupling means (15);

a signal track (34) for the shut-off means (14) is formed on an outer jacket (33) of the second section (4); and in the decoupled state of sections (2,4), with an end wall (18) of coupling means (15) that faces away from pressure chamber (20) riding on the signal track (34), the shutoff means (14) being shiftable via the coupling means (15) by the signal track (34) to the open position such that the inlet (22) to the pressure chamber (20) is opened.

3. Cam follower according to claim 1 or claim 2, characterized by the fact that the cam follower (1) is designed as a cup-shaped tappet whose first section (2) possesses an annular geometry, the cavity (8) running radially or in secant-like fashion in an area of a base (5) of the first section, and the second section (4) is produced with a circular shape, and is positioned within a borehole (3) of the first section (2), and the cavity (9) extending radially or in secant-like fashion in an area of a base (6) of the second section.

4. Cam follower according to claim 3, characterized by the fact that a slide (25) extends over an entire length of the cavity (9) of the second section (4) and has an end wall (37) facing the coupling means (15) which is in contact with the end wall (18) of coupling means (15) that faces away from the pressure chamber (20) during the base-circle phase, and for coupling of the first section with the second section (2,4) across the separating surface (19), engages partially in a cavity (8) in the first section (2) located diametrally opposite to the cavity (8) for coupling means (15).

5. Cam follower according to claim 4, characterized by the fact that the slide (25) is surrounded by a compression spring (27) acting in a direction toward the coupling means (15), the spring, at one end, is supported in the cavity (9) in a direction toward the opposing cavity (8) not having the coupling means (15) on a shoulder (28) and, at the other end, engages in an annular groove (30) on an outer jacket (26) of the slide or acts against a collar (29) or a retaining ring.

6. Cam follower according to claim 4, characterized by the fact that a stop (11, 31) for each of the coupling means (15) and the slide (25) is positioned radially outwardly in the cavity (8) for the coupling means (15) and in the diametrally opposing cavity (8) not having the coupling means (15), each of the stops (11, 31) includes an opening (13, 32).

7. Cam follower according to claim 2, characterized by the fact that the signal track (34) is formed on the second section (4) as a wedge-shaped diametral expansion (35) extending in a direction away from the cams or as a separate body (36) with a wedge surface, and has a greatest elevation at a maximum relative position of the first section (2) from the second section (4).

8. Cam follower according to claim 3, characterized by the fact that an hydraulic lash-adjusting element (7) is provided in the second section (4).

* * * * *